United States Patent [19]

Burr

[11] Patent Number: 4,841,309

[45] Date of Patent: Jun. 20, 1989

[54] ANTENNA WITH MOTORIZED POSITIONER

[75] Inventor: James D. Burr, Evergreen, Colo.

[73] Assignee: Echosphere Corporation, Englewood, Colo.

[21] Appl. No.: 158,203

[22] Filed: Feb. 19, 1988

[51] Int. Cl.[4] ..... H01Q 3/08

[52] U.S. Cl. ..... 343/766; 343/882

[58] Field of Search ..... 343/757, 761, 766, 839, 343/840, 882, 890

[56] References Cited

U.S. PATENT DOCUMENTS

| | | | |
|---|---|---|---|
| 4,538,155 | 8/1985 | Stewart | 343/882 |
| 4,617,572 | 10/1986 | Hugo | 343/766 |
| 4,654,670 | 3/1987 | Fleming | 343/882 |
| 4,663,635 | 5/1987 | Wu | 343/882 |
| 4,672,385 | 6/1987 | Pindle | 343/882 |
| 4,692,771 | 9/1987 | Rothbarth et al. | 343/766 |
| 4,726,259 | 2/1988 | Idler | 343/882 |

*Primary Examiner*—William L. Sikes
*Assistant Examiner*—Doris J. Johnson
*Attorney, Agent, or Firm*—Kolisch, Hartwell & Dickinson

[57] ABSTRACT

A dish for receiving satellite signals mounted on a stand through a casing which has a shaft projecting through the casing, the shaft having ends connected to the dish through bracket structure. Within the casing is a worm wheel mounted on the shaft. Also within the casing is a pivoted rocker plate mounting a worm gear and motor. The worm gear engages the worm wheel, and biasing means urges the rocker plate in a direction causing snug engagement of the worm gear and worm wheel. Shaft rotations are determined by electronic means.

8 Claims, 2 Drawing Sheets

ANTENNA WITH MOTORIZED POSITIONER

BACKGROUND AND SUMMARY OF THE INVENTION

This invention relates to an antenna having a motorized positioner connected thereto, whereby with operation of the positioner, the antenna is caused to shift on its mounting. More particularly, and as described herein, the invention concerns a positioner for moving a dish which receives signals from orbiting satellites, whereby the dish and its feed horn may be moved from a position aimed at one satellite, to pick up or acquire another satellite. While the invention is described in connection with such positioning of a signal-receiving dish, it is appreciated that features of the invention may have other applicability.

A so-called TVRO (television receiving only) dish is employed to receive signals from orbiting satellites in geosynchronous orbit over the equator of the earth. These satellites are approximately 23,000 miles in outer space, and are in orbit, but appear to remain stationary because of the rotation of the earth. With a so-called polar mount for the dish, i.e., a mount whereby the dish may be swung about an axis aligned in azimuth and elevation with the rotational axis of the earth, the dish may be swung about this pivot axis to change the satellite to which the dish is directed.

So-called linear actuators have been employed to move a TVRO dish. These are relatively inexpensive, and because of the geometry involved in the installation of a linear actuator, any play or looseness in the parts of the actuator does not introduce significant problems with respect to accuracy of positioning and dish movement caused by external factors such as wind buffeting. A disadvantage of a linear actuator is that such can produce controlled movement of a dish over an arc which is limited to about 140° , meaning that a linear actuator may not produce movement of a dish from horizon to horizon. A gear-drive type of actuator may be employed to move a dish from horizon to horizon, but because of the geometry involved in such a system, any play or looseness in the parts of the gear drive results in inconsistency in the accuracy of adjustment and renders the dish controlled thereby sensitive to displacement under the action of buffeting winds. To overcome this problem, gear-drive units may be manufactured with tightly meshed gears manufactured under close tolerances, but this type of unit generally requires a more powerful motor to produce adjusting movement, and with any wear occurring in the parts, looseness is introduced with attendant inaccuracy and instability.

In general terms, an object of this invention is to provide an improved power-operated antenna positioner, which may be utilized to move an antenna such as a dish from horizon to horizon, without looseness or play in the parts introducing the problems above described.

More specifically, an object of the invention is to provide such a positioner which utilizes a gear drive to position the antenna or dish, more specifically, a worm wheel and meshing worm gear, and a construction which eliminates undesirable looseness or play. Following the invention, mass produced worm wheels and worm gears may be employed in the gear drive, with sufficient clearance provided for smooth and quiet running of the gears and the motor driving the gears, any clearance in effect being taken up in such a manner as to eliminate play or slop and attendant problems heretofore encountered.

In a specific and preferred embodiment of the invention, a gear-drive unit is employed to produce adjustable movement in the dish or antenna, which includes a worm wheel secured to a shaft, the axis of the shaft providing the pivot axis for movement in the dish and the shaft being secured to bracket structures supporting the antenna. The shaft is turned or rotated through a worm gear and motor assembly, both supported on a rocker plate or rocker, which is pivotable about an axis extending transversely of the axis of the worm wheel shaft, in a direction causing the worm gear to move toward the worm wheel and into snug engagement with the worm wheel. The assembly is biased in this direction through biasing means, such as a spring interposed between the assembly and framework such as a casing which may be provided for enclosing the drive parts of the gear-drive unit. With the teeth of the worm wheel and the helical drive of the worm gear having a slight taper, and with the organization described, the gear and wheel are always in snug engagement without undue loading of the motor which powers the unit and without conditions producing wear in the parts. The gear drive of the unit is self-adjusting, with the elimination of slop or looseness, even after repeated cycling of the dish or antenna across the sky.

BRIEF DESCRIPTION OF THE DRAWINGS

These and other objects and advantages are obtained by the invention, which is described hereinbelow in conjunction with the accompanying drawings, wherein.

DETAILED DESCRIPTION OF THE PREFERRED EMBODIMENT

Figure 3:
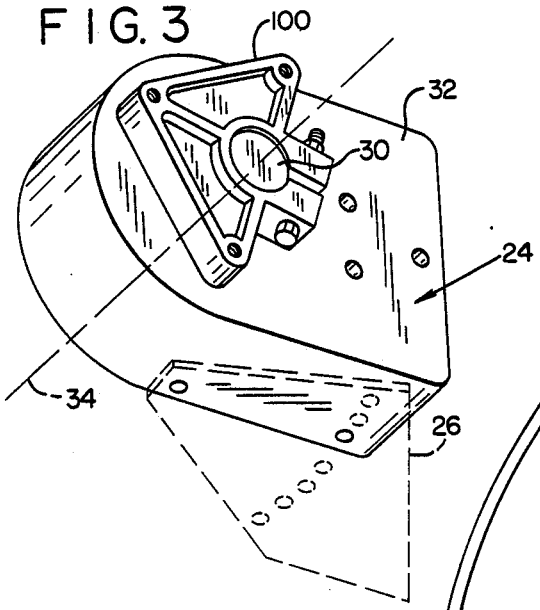
FIG. 3 is a perspective view, on a somewhat larger than FIG. 2, but looking downwardly and at an angle at the motorized gear-drive unit which is part of the mounting for the dish.
Figure 1:
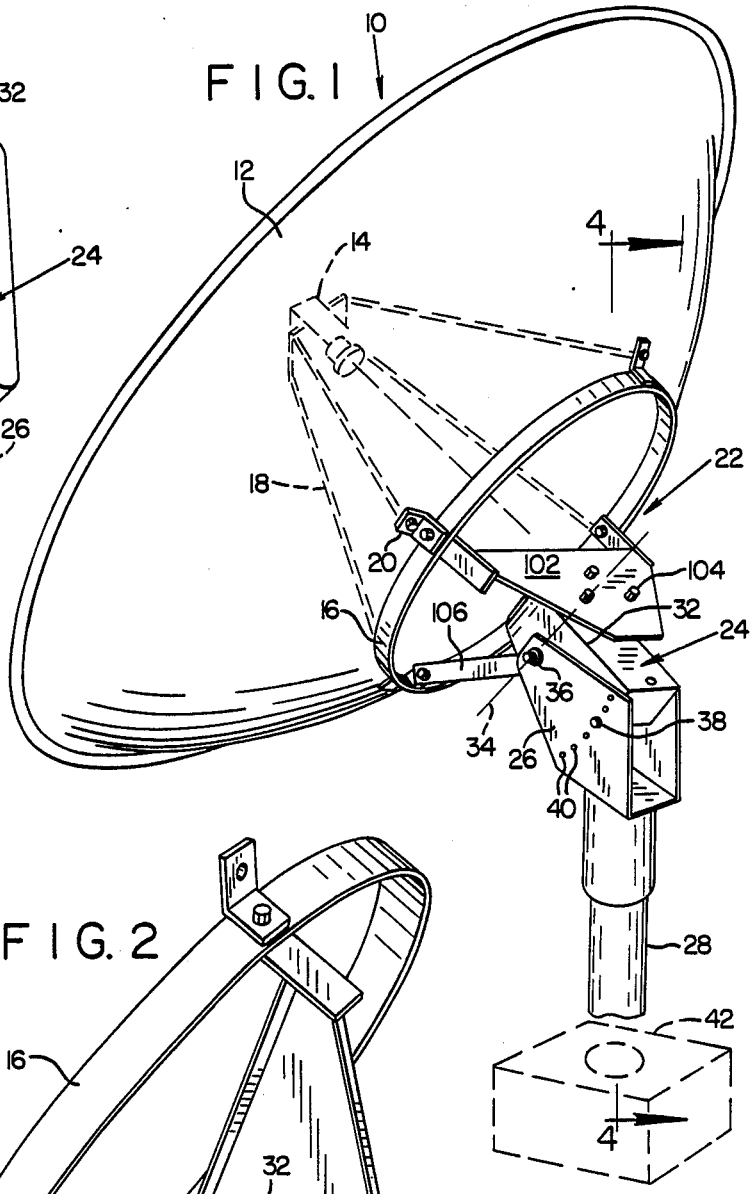
FIG. 1 is a perspective view illustrating a TVRO dish and a mounting which supports the dish, which includes a stand and a motorized gear-drive unit as contemplated by the invention.
Figure 2:
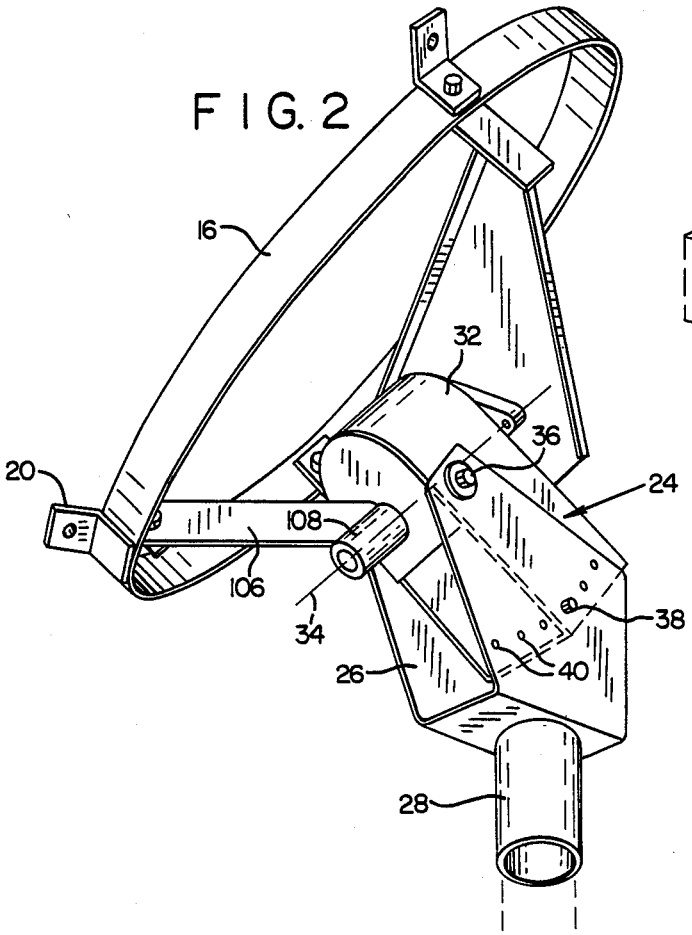
FIG. 2 is a view, on a somewhat larger scale, and also in perspective, but looking upwardly from the underside of the mounting for the dish, and more particularly at that portion of the mounting which includes the motorized gear-drive unit.

Referring now to the drawings, and first of all, more particularly to FIGS. 1–3, shown at generally at 10 is a TVRO dish assembly which includes a parabolic reflector shown at 12 and in front of the reflector, a feed horn 14. The dish assembly is supported in a position, normally above the ground, by mounting structure which includes a ring 16 appropriately secured to the back side of reflector 12, ring 16 being secured to horn 14 through rods 18 having ends joined to the ring through angle pieces 20. The mounting for the dish assembly further includes bracket structure indicated generally at 22 supporting the ring on a gear-drive unit or motorized positioner, indicated generally at 24. The gear-drive unit is mounted on a channel-shaped bracket 26. Bracket 26 in turn is mounted on the upper end of an upstanding post 28.

As will hereinafter be described in greater detail, bracket structure 22 connects the dish assembly to an adjustor shaft extending from the top and bottom of a casing 32 which houses the gear-drive unit, the adjustor shaft being rotatable about an axis indicated in FIGS. 1 and 2 at 34. In shifting the dish assembly from one satellite to another, the dish assembly is swung about axis 34.

The dish assembly is supported in what is referred to herein as a polar mount, in that the support for the dish assembly is adjusted in azimuth and elevation to place axis 34 in parallel alignment with the rotational axis of the earth. In this connection, it will be noted that casing 32 of the gear-drive unit is supported on bracket 26 by a fastener 36 which supports the forward part of the casing, and a fastener 38 which supports a rear portion of the casing. A series of ports 40 are provided in the sides of bracket 26. By loosening fastener 36 and removing fastener 38, the casing may be swung about the axis of fastener 36 to produce a course adjustment in the elevation of the casing, i.e., the angle of the casing relative to the ground, with fastener 38 placed through an appropriate port to secure the casing in its adjusted position. Fine adjustment in the elevation of the casing is permitted by reason of fastener 36 extending through a slot (not shown) in bracket 26 permitting incremental shifting of the position of the forward part of the casing. Azimuthal adjustment in the mounting for the dish assembly is permitted as by providing a means indicated generally and schematically at 42 for turning post 28 about its axis.

Figure 5:
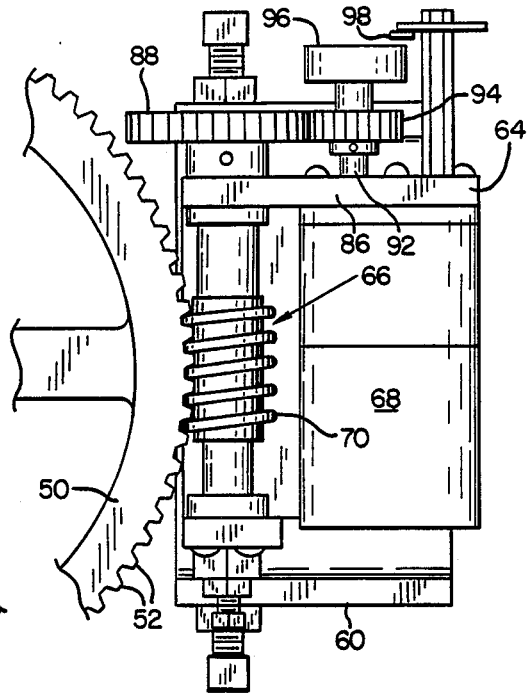
FIG. 5 is a view taken generally along the line 5-5 in FIG. 4.
Figure 4:
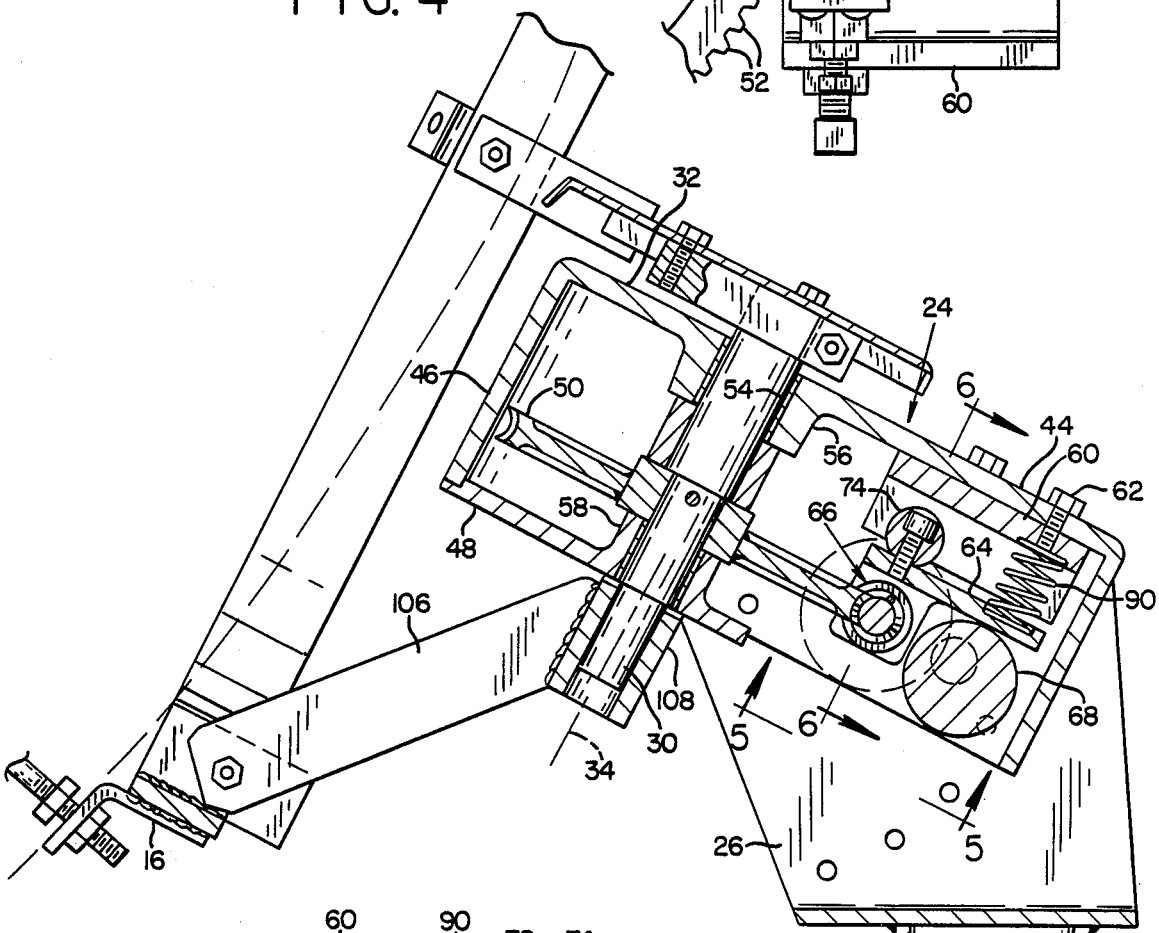
FIG. 4 is a cross-sectional view taken along the line 4—4 and on a larger scale, of the gear-drive unit.
Figure 6:
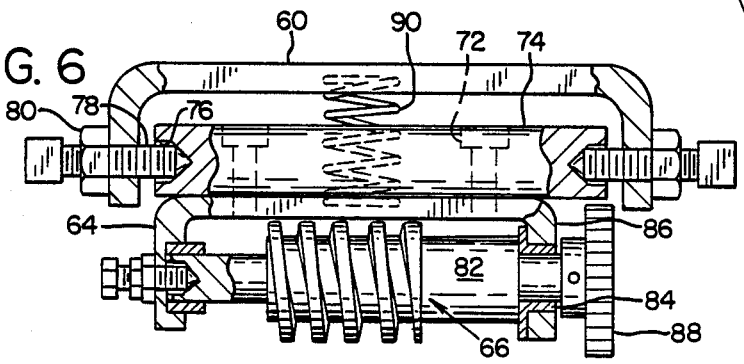
FIG. 6 is a view taken generally along the line 6-6 in FIG. 4.

Considering now in more details of the gear-drive unit or positioner 24, and referring now also to FIGS. 4, 5 and 6, casing 32 is hollow and includes an upper wall 44, a perimeter wall 46 bounding the casing between its upper and lower sides, and a removable lower wall 48 forming the bottom side of the casing and suitably secured in place to perimeter wall 46.

The adjustor shaft earlier referred to is shown at 30. Such extends through the casing and has an upper end projecting beyond the upper wall and lower end projecting downwardly beyond lower wall 48 of the casing. Encircling the shaft and disposed within the casing, and suitably fixed to the shaft, is a worm wheel 50 with worm wheel teeth 52 extending about the perimeter thereof. The teeth have a slight taper in a direction extending radially of the worm wheel. The worm wheel is suitably rotatably supported within the casing, as by bearing 54 and bosses 56, 58. By reason of its securement to the worm wheel, the adjustor shaft may also be thought of as a worm wheel shaft in the gear-drive unit.

Shown at 60 is a shallow channel-shaped piece which is secured by fasteners 62 to the underside of upper wall 44 in the casing. This provides a mounting for a rocker plate or rocker element 64, which mounts a worm gear 66 and a DC electric motor 68, with the helical drive gear 70 of the worm gear engaging teeth 52 of the worm wheel.

More specifically, secured as by fasteners 72 to the rocker element is a pivot shaft 74 having counter-bores 76 at opposite ends thereof bottomed by conical surfaces. Seated in these counter-bores are the tapered ends of bolts 78 secured in an adjusted position by nuts 80. The organization enables accurate positioning of the pivot shaft with the shaft being pivotable about an axis extending transversely of the worm wheel shaft at a location parallel to and laterally spaced from the axis of the worm gear.

The worm gear is mounted on a worm gear shaft 82 suitably journaled as by bearings 84 in depending portions 86 of the rocker element. Secured to an end of the worm gear shaft is a spur gear 88.

Interposed between channel-shaped piece 60 and the rocker element is a biasing means, more specifically, a coil spring 90. The rocker element, by reason of its pivotal mounting, constitutes a support for the worm gear mounted for movement in a defined path within the casing, more specifically, arcuate movement about the axis of pivot shaft 74. The spring biases the rocker element 64 in a clockwise direction in FIG. 4, such movement urging the helical drive gear of the worm gear toward and into snug engagement with the teeth of the worm wheel. The helical drive gear of the worm gear has a tapered cross-section, and with such pivotal movement and by reason of the tapered profile of the teeth on the worm wheel, the spring operates to produce snug engagement of the helical drive gear and worm wheel teeth devoid of any looseness or play between these parts.

Electric motor 68 is supported on the rocker element to one side of the worm gear. Its output shaft 92 has mounted thereon a spur gear 94 with teeth meshing with the teeth of spur gear 88. Thus, a nonslip driving connection is established between the output shaft of the motor and the worm gear.

Mounted on the extreme end of the output shaft of the motor is a magnet 96, and mounted adjacent this magnet and supported on the rocker element is a reed switch 98. The reed switch, through opening and closing as induced by the magnet, with rotation of the magnet, maintains an electronic count of the rotations which have occurred in the motor output shaft, this being related to the rotations occurring in the worm gear. With suitable electronic means connected to the reed switch, means is provided permitting controlled actuation of the DC motor to produce rotation of the worm gear to the extent necessary to move the dish assembly from a position aimed at one satellite to a position aimed at another selected satellite.

The dish assembly is supported on the protruding ends of actuator or worm wheel shaft 30. More specifically, and referring also to FIG. 3, the upper end of the worm wheel shaft has secured thereto an arrow-shaped element 100 which is pivoted through turning of the worm wheel shaft. Bracket plate 102 of bracket structure 22 is secured by fasteners 104 to element 100. Bracket structure 22 further includes a strut 106 on the underside of the antenna joined to a tubular element 108 which encompasses and is secured to the lower end of the worm wheel shaft.

Generally describing the operation of the apparatus described, to produce movement of the dish assembly whereby it is shifted to be directed toward a new satellite, DC motor 68 is energized to rotate spur gear 94 and with it spur gear 88 secured to the worm gear. Rotation of the worm gear produces turning of the worm wheel and pivotal movement of the dish assembly about axis 34. Movement continues until the electronic control for the motor commands the motor to stop, stopping occurring when the dish assembly reaches a position directed toward the new satellite.

With the biasing means described, any looseness or play in the internal parts of the casing is taken up, with the helical drive gear of the worm gear always snugly engaging the teeth of the worm wheel. There is no need to use precisely machine gear parts. The dish assembly is firmly supported from buffeting by the wind. Positioning of the dish assembly is accurate and this accuracy is maintained after repeated cycling of the parts.

While an embodiment of the invention has been described herein in detail, variations and modifications are possible without departing from the invention.

It is claimed and desired to secure by letters patent:

1. A motorized antenna positioner comprising:

a frame, an adjuster shaft rotatably mounted on said frame and means operatively connected to the adjuster shaft which is shifted by turning of the adjuster shaft to position an antenna, a worm wheel element with worm wheel teeth operatively connected to the adjuster shaft, a worm gear element with a worm gear drive, a mounting for the worm wheel element and worm gear element whereby the axis of the worm gear element is spaced from and extends transversely of the axis of the worm wheel element and the worm gear drive meshes with the worm wheel teeth, said mounting including biasing means yieldably biasing said elements in a direction urging the axis of the wheel element and the axis of the gear element toward each other, a motor with output shaft and means drivingly connecting the output shaft of the motor and the worm gear element whereby operation of the motor produces rotation of the worm gear element.

2. The antenna positioner of claim 1, wherein said mounting for said elements includes a support mounted for movement on said frame in a defined path, and means rotatably mounting the worm gear element on said support, said biasing means yieldably urging said support for movement relative to said frame in one direction in said path and such movement shifting the axis of the worm gear element toward the axis of the worm wheel element.

3. The antenna positioner of claim 2, wherein said motor is mounted on said support together with said worm gear element, and the means drivingly connecting the output shaft of the motor and the worm gear element is a nonslip drive-transmitting means, and which further includes electronic means operatively counting the rotations of the worm gear element.

4. A motorized antenna positioner comprising:

a hollow casing, a worm wheel assembly including a worm wheel and a worm wheel shaft secured to the worm wheel, the worm wheel being disposed within the casing and the shaft being secured to the worm wheel and having at least one end projecting outside the casing, means rotatably mounting the worm wheel assembly on said casing, a rocker plate, and means pivotally mounting the rock plate within said casing, a worm gear journaled on said rocker plate engaging the worm wheel, the means pivotally mounting the rocker plate providing a pivot axis substantially paralleling the axis of the worm gear, biasing means urging pivotal movement of the rocker plate in a direction urging said worm gear against said worm wheel, a motor within said casing drivingly connected to the worm gear, and means mounted on said one end of the worm wheel shaft adapted to be connected to an antenna for positioning the antenna with rotation of said shaft.

5. The motorized antenna of claim 4, wherein the motor is mounted on said rocker plate and includes an output shaft paralleling the worm gear axis, and the means drivingly connecting the motor to the worm gear comprises a gear train interconnecting the two.

6. The motorized antenna positioner of claim 5, wherein the worm wheel shaft includes an end opposite said one end projecting outside the casing, and said opposite end of said shaft has means for securing an antenna thereto.

7. The motorized antenna positioner of claim 6, where further includes a mounting for said casing, and wherein the mounting for the casing includes adjustable means permitting alignment of the worm wheel shaft, in azimuth and elevation, with the rotational axis of the earth.

8. The combination of an antenna dish adapted to receive signals from orbiting satellites where the satallites are in geosynchronous orbit over the equator of the earth, and a mounting for said dish supporting the dish above the ground including a stand, bracket structure secured to the antenna dish, and a hollow casing having a shaft extending therethrough, with opposite ends of the shaft protruding from the casing, said bracket strucure being secured to said ends of the shaft and said casing being mounted on said stand, the mounting for the dish further including adjustable means to establish a polar mount for the dish whereby the axis of the shaft is in parallel alignment with the rotational axis of the earth, the casing including motorized means energizable to shift the dish by turning of said shaft whereby the dish may be moved to acquire different satellites in said orbit, said motorized means comprising a worm wheel within said casing having said shaft secured thereto and extending therethrough, a worm gear engaging said worm wheel extending transversely of the axis of said shaft, a rocker plate disposed within the casing and means pivotably mounting said rocker plate for pivotal movement about an axis paralleling the axis of the worm gear, said worm gear being journaled on said rocker plate at a point spaced from said pivot axis, biasing means interposed between the rocker plate and casing urging the plate to pivot whereby the worm gear moves against the worm wheel, a motor with an output shaft mounted on the rocker plate and movable with the rocker plate, gears interconnecting the output shaft of the motor and said worm gear whereby the two rotate, and electronic means for establishing the number of rotations imparted to the worm gear by said motor.

* * * * *